US005476397A

United States Patent [19]

Leff et al.

[11] Patent Number: 5,476,397

[45] Date of Patent: Dec. 19, 1995

[54] WIRE TERMINAL CLAMP

[75] Inventors: Kenneth J. Leff, Cambridge, Mass.; Charles Lacarrubba, Smithtown, N.Y.

[73] Assignee: Pittway Corporation, Syosset, N.Y.

[21] Appl. No.: 142,613

[22] Filed: Oct. 25, 1993

[51] Int. Cl.[6] ..... H01R 4/30

[52] U.S. Cl. ..... 439/727

[58] Field of Search ..... 439/723–725, 439/727, 728, 863

[56] References Cited

U.S. PATENT DOCUMENTS

| | | | |
|---|---|---|---|
| 2,672,595 | 3/1954 | Barr | 439/727 |
| 3,021,502 | 2/1962 | Lehman | 439/727 |
| 3,867,007 | 2/1975 | Wening | 439/727 |
| 5,173,060 | 12/1992 | Shimirak | 439/727 |

*Primary Examiner*—Larry I. Schwartz
*Assistant Examiner*—Hien D. Vu
*Attorney, Agent, or Firm*—Ladas & Parry

[57] ABSTRACT

Wire terminal clamp having a wire receiving means situated in a surface, a wire clamping member and a means for moving the wire clamping member across the surface, so that when the wire clamping member is moved in one direction a wire end can be clamped and when the wire clamping member is moved in an opposite direction any wire end that is clamped can be released.

36 Claims, 5 Drawing Sheets

WIRE TERMINAL CLAMP

BACKGROUND OF THE INVENTION

This invention relates to a wire terminal clamp. The wire terminal clamp of this invention can be used as a component of an electrical connector, which can be used in sensors, computers, security systems and the like.

DESCRIPTION OF THE PRIOR ART

Low level signals, such as those used in computerized security systems, require electrical connectors that provide low, consistent contact resistance readings under a wide variety of conditions. These connectors must be installable by a relatively unskilled field force and they must be able to withstand the rigors of UL testing.

A number of different types of electrical connectors have been utilized for this purpose: screw terminals, crimps, insulation piercing, insulation displacement and twist and solder. Insulation displacement (IDC) has emerged as the system of choice, because it can be accomplished at low cost, and can be installed by a relatively unskilled person using only a stylus or a small screwdriver.

The IDC's known in the art primarily consist of a tapered slot in a thin piece of metal, disposed so that the component leadwires can be placed in the slot, and pressure applied to the outer insulation in order to force the wire down the taper until the insulation has been penetrated and the metal edges are in intimate contact with the inner conductor. However, existing IDC's have the following disadvantages: 1. limited range of wire sizes (not enough room for a sufficiently long, properly tapered slot), 2. limited range of insulation durometer (blunt strip edges cannot easily displace hard, thick dielectric materials), and 3. are limited to solid (or stranded and fused) wire. (Strands can slide over each other and cause loss of contact pressure due to heat, mechanical stress or vibration in the field).

In a typical IDC, the individual wires can slip over each other as a result of being forced into the tapered slot. It will be evident to those familiar with the art that such slippage can continue under field conditions, exacerbated by elevated temperatures, until creep of the wire insulation has taken place, at which point the contact pressure is seriously reduced and the joint becomes unreliable. It will also be evident that the length and taper of the slot is limited, by miniature package constraints, so that the IDC can only accommodate a narrow range of wire diameters, and its application is limited to use with solid or fused wire construction.

SUMMARY OF THE INVENTION

This invention relates to a wire terminal clamp for clamping wires of different diameters. The wire terminal clamp of this invention can also be used to clamp single or multi stranded wires. The wire terminal clamp utilizes sharp-edged vee shaped openings in a tough conductive material and a plate moveable in respect to these openings to penetrate the insulation of electrical wiring and at the same time, compress stranded conductors into a bundle, forming a reliable joint in which the strands cannot slip over each other to cause a loss of contact pressure under thermal and/or mechanical stress. Because of the closing vee configuration, stranded wire is compacted into a square or diamond shaped mass rather than the flattened or oval shape which is characteristic of ordinary IDC's so that a reliable connection is achieved, even over a broad range of wire OD's and ID's. The movement of the plate causes the vees to close down on the wire, so that the edges cut through the insulation and bite into the conductor, making a highly reliable joint. The opposing edges of the plates are tapered to form a thin edge that is capable of penetrating tough, thick plastic insulation, but it is not so sharp that it will become nicked by closing down on wire.

The edge angle selected for a broad range of insulation hardness is 30 degrees, but this can be adjusted as required for specific applications.

Mechanical stops are provided to prevent the sharp vees from biting too deeply into the smallest diameter conductors. The elements are designed to flex slightly at full compression, thus providing enough overtravel to compensate for thermal and mechanical stress.

Wires that are clamped in the wire terminal clamp are in contact with the conductive metal of the wire terminal clamp to enable an electrical component (e.g. reed switch) within the electrical connector to be energized.

OBJECTS OF THE INVENTION

It is an object of the present invention to provide a wire terminal clamp with quick clamp and quick release features.

It is a further object of this invention that single or multi-stranded wire can be clamped.

It is another object of this invention that wires of different diameters can be clamped.

It is a still further object of this invention that a clamped wire is not splayed.

It is yet another object of this invention that a reliable electrical connection can be made using the clamp of this invention.

DESCRIPTION OF THE PREFERRED EMBODIMENT

Figure 1:
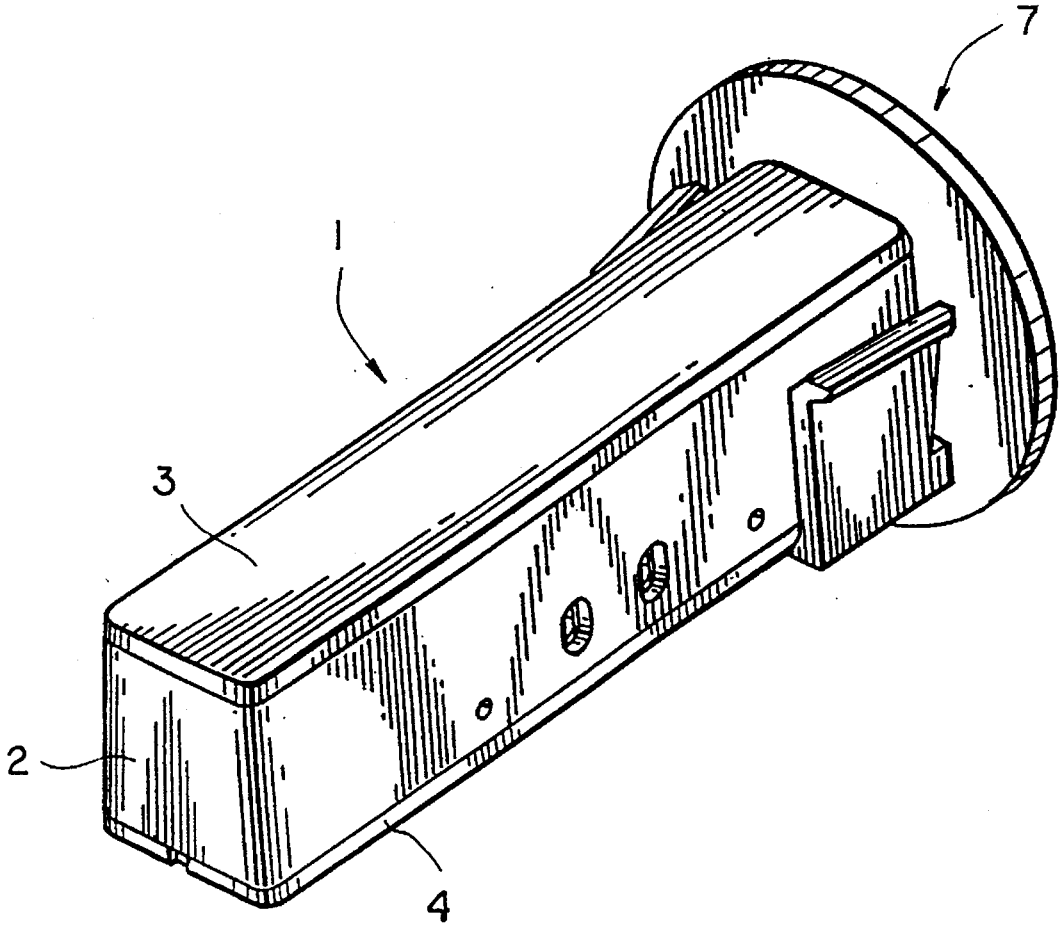
FIG. 1 is a perspective view of a wire terminal receptacle embodying one or more wire terminal clamps of the invention.

Referring now to the drawings, FIG. 1 shows an assembled wire terminal receptacle (1) that has a substantially elongated shape. The receptacle includes a domed housing (2), a plate (3) situated on top of the housing and a base (4) on which the housing rests. An adhesive can be affixed to the bottom of the base so that the wire terminal receptacle can be mounted in a desired location.

Figure 2:
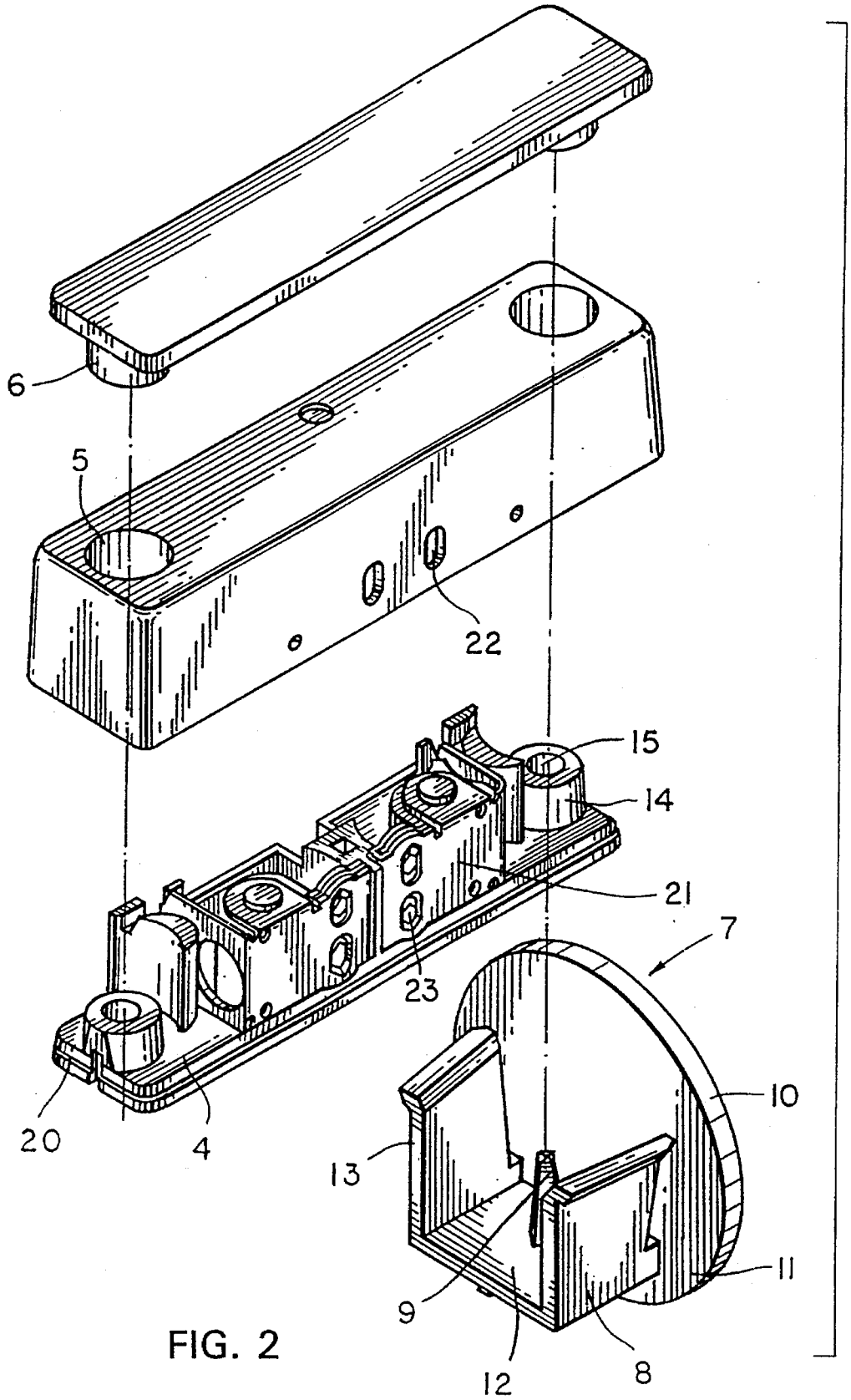
FIG. 2 is an exploded view of the wire terminal receptacle of FIG. 1.

The means by which the plate and the housing fit together are seen in FIG. 2. There are bore holes (5) on top of the housing that are aligned to mate with pins (6) of the plate so that a friction fit is established between the pins and the bore holes to enable the plate to fit on top of the housing. Screws used to mount the wire terminal receptacle in place can be inserted in the bore holes (5) prior to fitting the plate on the housing. The plate can be labelled for identification, for example, with the name of a manufacturer or distributor.

The wire terminal receptacle shown in FIG. 1, is supported at a first end by an end support (7). The end support (7) is also seen in FIG. 2. The end support includes a U-shaped trough member (8), and an aligning post (9). The end support (7) also includes an end wall (10) of substantially circular shape, having an exterior side (not shown) and an interior side (11). The trough member (8) has a base (12), two symmetrical arms (13) and is connected to the interior side (11) of the end wall (10). The trough member is positioned on the end wall so that neither the base nor the arms of the trough touch the perimeter of the interior side of the end wall. The trough member is positioned on the interior side of the end wall so that one edge of the base of the trough is connected to the interior side of the end wall. As shown in FIG. 2, a bottom portion of the arms is connected to the interior side of the end wall to form a slot from the top of the arms to the point where the arms are connected to the interior side of the end wall. The distance between the top edge of one of the arms to the top edge of the symmetrical arm is greatest near the interior side of the end wall and this distance decreases the further the arms extend from the wall. The top edges of the arm are turned out. The outturned edges of the arms and the spacing between the arms aid in the seating of the wire terminal receptacle in the trough member (8) and consequently in its support by the end support (7).

To provide additional support for the wire terminal receptacle, the end support (7) also contains an aligning post (9) situated on top of the base (12) of the trough (8). The aligning post is centered between the arms of the trough and it is closer to the interior side of the end wall than it is to the outer edge of the trough. The aligning post friction fits within an apertured boss (14) of the base (4) that has an opening at the bottom of the base (4) and an opposite opening (15) above the base. An opening at the bottom (16) of the base can be seen in FIG. 6. When the aligning post is situated in the apertured boss (14), the wire terminal receptacle is seated in the trough and is held in place by the arms of the trough. A second end support of the same construction and operation can be used to support a second end of the wire terminal receptacle (1).

There is a support bracket (18) situated on the underside of the trough. This can be seen in FIG. 6. The support bracket extends from the interior side (11) of the end support (7) to the edge (19) of the trough (8) opposite to the interior side of the end support. The support bracket while extending to the edge of the trough does not have to be aligned with the edge of the trough. The height of the support bracket decreases as the bracket extends from the interior side of the end wall to the edge of the trough. The support bracket is located approximately midway between the arms of the trough. The edge of the support bracket is stepped.

Figure 6:
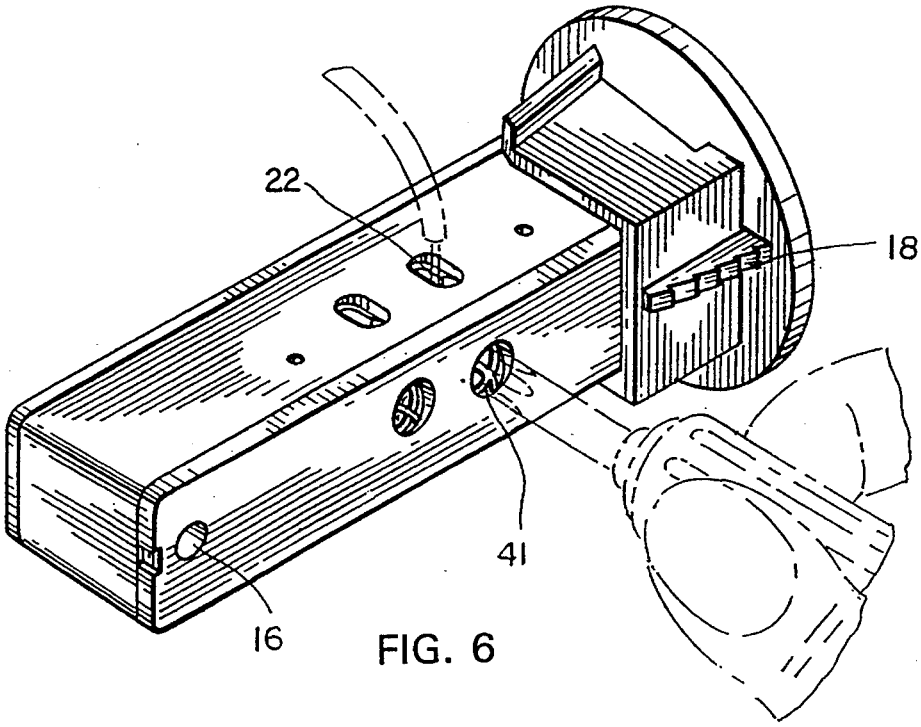
FIG. 6 is a perspective view similar to FIG. 1 showing schematically the securing of a wire end.

The interior of the wire terminal receptacle can be seen in FIG. 2. The base has a stepped ledge (20) and the housing is dimensioned so that the housing can friction fit on the base over the stepped ledge of the base to cover wire terminal clamps (21) and any other components situated on the base. In an alternative embodiment, the housing has a stepped ledge that mates with the stepped ledge of the base. When the housing in positioned on the base, the housing protects the wire terminal clamps and any wires that are clamped and a chamber is formed between the housing and the base to catch any stray bits of insulation that may be generated by repeated clamping of wires in the wire terminal clamps. As seen in FIG. 2, two wire terminal clamps (21) are seated on the base and are seated to be in mirror image of each other. The wire terminal receptacle is configured so that aperture (22) of the housing is in series with an aperture (23) of the wire terminal clamp so that when a wire is inserted into aperture (22), and extends into aperture (23) of the wire terminal clamp, the wire can be clamped. In another embodiment, there is a second aperture in the housing that is in series with a second aperture of the wire terminal clamp (21). In another embodiment where there are two wire terminal clamps seated on the base and there are two apertures in the housing. FIG. 6 illustrates the insertation of a wire into aperture (22). In this figure, the insulation has been stripped from the wire prior to its insertion into aperture (22). It is not necessary to remove the insulation from the wire before inserting or clamping the wire. In the embodiment shown in the Figures, apertures (22) are located only on one side of the housing.

Figure 5:
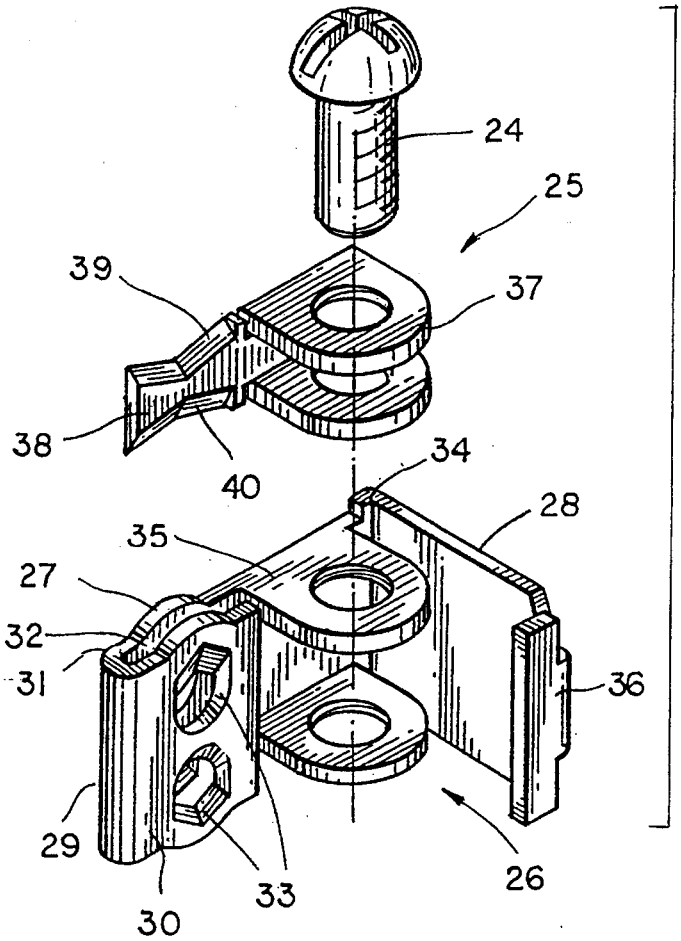
FIG. 5 is an exploded view of the wire terminal clamp of FIG. 4.

The structure of the wire terminal clamp (21) is seen more clearly in FIG. 5. The wire terminal clamp has a screw threaded member (24), a carriage (25) and a wire terminal bracket (26). The wire terminal bracket has two limbs (27, 28) that are at approximately 90° angle to each other. At a first end of the bracket (29), a surface is overturned on itself to form an overlying surface (30) and an underlying surface (31). There is a channel (32) formed between these overlying and underlying surfaces. As shown in FIG. 5, there are two apertures (33) in the overlying surface (30) that are in mirror image to each other. Each aperture (33) is aligned with an aperture (23) in the underlying surface so that in the embodiment shown in the figures, a wire can pass through the aperture on the underlying surface through the aperture on the overlying surface. In another embodiment there is only a single set of apertures, whereby there is an aperture in the underlying surface and a corresponding aperture in the overlying surface.

In the embodiment shown in the figures, a first set of apertures in the overlying surface (33) and underlying surface (23) are configured so that one side of the aperture is rounded and the opposite side has a vee-shape. The vee has sharp edges for penetrating the insulation of a wire. In another embodiment where there is no insulation on the wire end, it is not necessary that the vee have sharp edges. The second set of apertures shown in FIG. 5 are in mirror image to the first set, so that in one set of apertures the vee is right side up and in the other set, the vee is upside down.

Positioned between the end of the bracket (29) and the junction (34) between the limbs (27, 28) of the bracket, are two nonscrew threaded upstanding lugs (35). One lug extends from the top of limb (27) and the second lug extends from the bottom of limb (27), so that the lugs are parallel to each other. At a second end of the bracket (26) at the end of limb (28), is a flange (36) that is formed by overturning the end of the limb (28) at an angle of approximately 90°. One of the purposes of the flange is to aid in the seating of the wire terminal clamp on the base (4).

As stated above, another component of the wire terminal clamp is the carriage (25). At a first end of the carriage, there are a pair of upstanding screw threaded lugs (37). At a second end of the carriage, there is a diablo shaped plate (38) having recesses at opposite sides of the plate that are angular vee-shaped clamping edges (39, 40). When the wire terminal clamp is assembled, the carriage sits within the nonscrew threaded lugs (35) of the bracket (26) so that the arrangement of the lugs is that there are nonscrew threaded lugs on the top and bottom of the wire terminal clamp and screw threaded lugs situated between the nonscrew threaded lugs of the wire terminal clamp. Additionally, as a result of the arrangement of the carriage (25) being seated between the nonscrew threaded lugs, the plate (38) of the carriage fits within the channel (32) that is formed by the overlying and underlying surfaces of the bracket. The plate (38) fits within the channel so that it is moveable in the channel.

Figure 4:
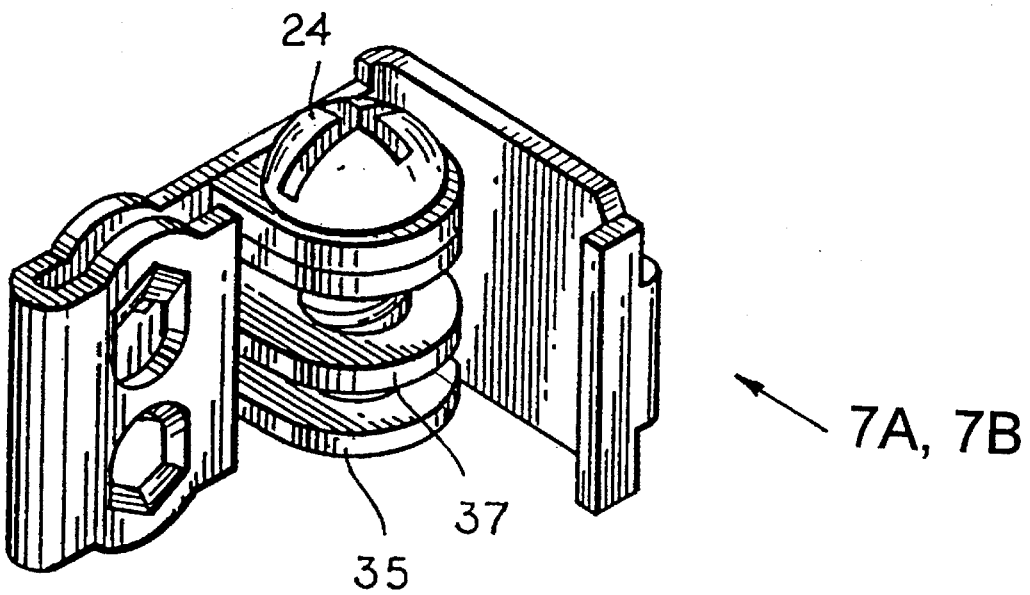
FIG. 4 is an enlarged perspective view of the wire terminal clamp of FIG. 3.

When the carriage is situated between the nonscrew threaded lugs of the bracket and the plate is in the channel, the screw threaded member (24) of the wire terminal clamp is inserted into one of the nonscrew threaded lugs so that it extends through the screw threaded lugs. In an embodiment of the clamp, the screw threaded member would extend through a nonscrew threaded lug, through the screw threaded lugs which are connected to the plate and through a second nonscrew threaded lug. This is seen in FIG. 4. The screw threaded member is inserted into the lugs in such a way that the screw threaded member is moveable in the lugs. The movement of the screw threaded member in the screw threaded lugs causes the plate to move in the channel. FIG. 6 shows a mechanism by which the screw threaded member can be moved.

Figure 7A:
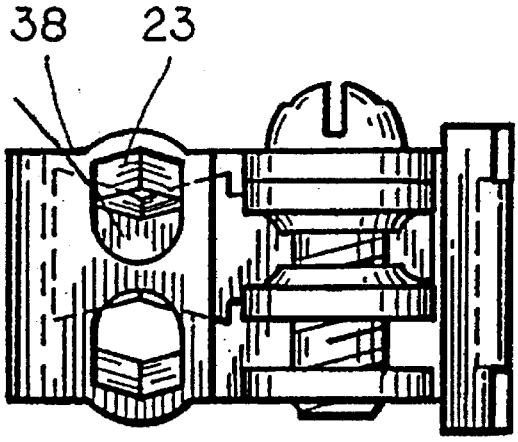
FIG. 7A is an enlarged side elevation of the wire terminal clamp of FIG. 4
Figure 7B:
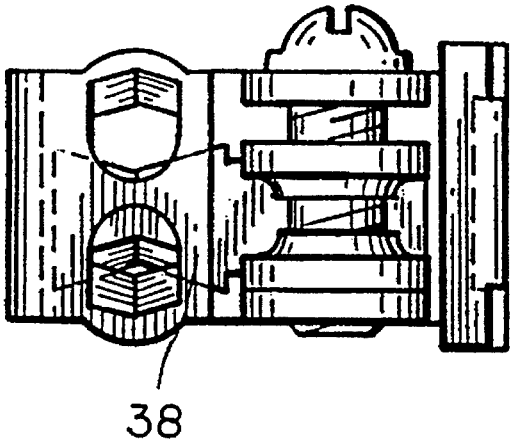
FIG. 7B is a view similar to FIG. 7A showing the wire terminal clamp in a second position.

FIG. 7A shows a first position of the plate (38) in the channel. FIG. 7B shows a second position of the plate in the channel. In the first position, the plate partially occludes aperture (23) and the corresponding aperture in the underlying surface. The edge of the plate (38) meets the edges of the vee of the aperture so that a wire can be engaged and clamped between the clamping edge (39) of the plate and the edges of the aperture. In the second position, the plate partially occludes the second aperture and the corresponding aperture in the underlying side and the edge of the plate (40) meets the edges of the vee of the aperture and a wire can be engaged and clamped between the clamping edges (40) of the plate and the vee shaped edges of aperture. In the second position, a wire that was clamped in the first position would be released. It also follows that a wire clamped in the second position would be released if the plate is moved into the first position.

Figure 3:
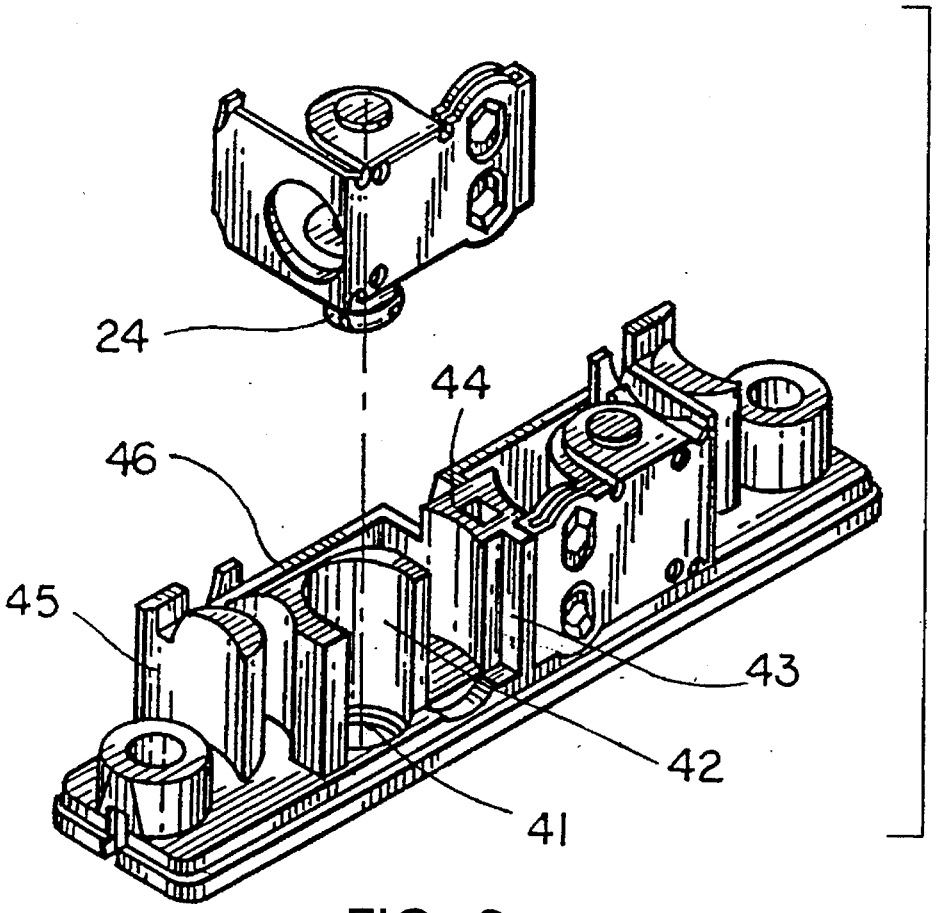
FIG. 3 is an exploded view showing a wire terminal clamp and mounting, therefor.

The screw threaded member (24) can also be used to secure wire terminal clamp on the base (4). As seen in FIG. 3, the leading end of the screw threaded member extends into the adhesive that is affixed to the underside of the base (4) through the aperture (41) that extends through the base into the wire terminal clamp. Optionally, the aperture (41) through which the screw threaded member is positioned is at a 90° C. angle to the apertures (22) on the side of the housing through which the wire to be clamped is inserted. This can be seen in FIG. 6.

In addition to the optional use of the screw threaded member to fix the wire terminal clamp (21) to the base (4), there are other components on the base which help to support the wire terminal clamp on the base.

The lugs of the wire terminal clamp are supported by a semicircular cylindrical retaining wall (42) so that the retaining wall surrounds the sides of the lugs that extend outward from the bracket. The channel end of the bracket is supported at the closed end of the channel by retaining wall (42) and an arm (43) extending from a box like support (44) which is positioned to support both wire terminal clamps shown in FIG. 3. The limb (28) of the bracket is supported by the outside wall of the retaining wall (42) and by member (45) so that flange (36) is supported by the outside wall of the circular retaining wall (42) and panel (46). Member (45) has a concave shape to fit the bore holes (5) of the housing. When the clamp is seated on the base there is an open space between the retaining wall the box-like support (44) and the panel (46). The end of wire that is clamped extends into this space. As can be seen from FIG. 3, except for the box-like support (44) and the arm (43) extending from this support, there is a second set of support means that is in mirror image to the first set of the support means. This second set of support means can be used to support a second wire terminal clamp.

A reed switch can be connected from the flange (36) of one wire terminal clamp to the flange of a second wire terminal clamp seated on the base. The reed switch can be soldered to the flanges so that the wires of the reed switch rest in the indentations formed between member (45) and panel (46). Between the box like support (44) and the panel (46) a space is formed for the placement of a magnet.

The mechanism of connecting and disconnecting a wire end in the clamp will now be described. The wire can be single or multistranded. It is not necessary to remove the insulation from the wire before it is inserted into the housing at aperture (22). The wire terminal receptacle is designed so that aperture (22) is aligned with the apertures in the underlying and overlying surfaces of the bracket of the wire terminal clamp. The wire to be clamped is inserted in aperture (22) extends into the aligned aperture of the underlying surface through the channel and through the aligned aperture of the overlying side. The end of the wire extends into the space between the retaining wall (42), the box-like structure (44) and the panel (46).

Once the end of the wire passes through apertures, it can be clamped. As seen in FIG. 6, a tool can be used to turn the screw threaded member. When the screw threaded member is turned, it causes the carriage (25) of the wire terminal clamp to move, and consequently causes the plate (39) in the channel (32) to move. If the screw is turned in one direction, the wire will be clamped between the clamping edges of the plate and the vee shaped edges of the aperture. If the screw is turned in an opposite direction, the wire will not be clamped and the wire will be released.

We claim:

1. A wire terminal clamp comprising a wire receiving means situated in a surface, a wire clamping plate having a recess at one edge dimensioned to accommodate a wire end and a means for moving said wire clamping plate across said surface in a first direction and in a second opposite direction, such that when the wire clamping plate is moved in the first direction a wire end received in said wire receiving means can be engaged by said recess and clamped and when the wire clamping plate is moved in the second opposite direction the wire end that is engaged and clamped can be released.

2. The wire terminal clamp according to claim 1 wherein the wire receiving means is an aperture.

3. The wire terminal clamp according to claim 1 wherein the surface underlies the wire clamping plate and has an aperture to receive a wire.

4. The wire terminal clamp according to claim 1 wherein the wire receiving means is located on a wire terminal bracket.

5. The wire terminal clamp according to claim 4 wherein the wire receiving means is situated at one end of the wire terminal bracket.

6. The wire terminal clamp according to claim 1 wherein the surface is an underlying surface and is overturned on itself to form an opposing overlying surface such that a channel is formed between the underlying surface and the overlying surface, and wherein said wire clamping plate is moveable in said channel.

7. The wire terminal clamp according to claim 6 where the wire clamping plate is moveable by screw feed means.

8. The wire terminal clamp according to claim 6 wherein there is an aperture in the overlying surface that is aligned with an aperture in the underlying surface, such that the wire end received in one aperture will traverse the channel to be engaged in the aperture in the other surface.

9. The wire terminal clamp according to claim 8 wherein there is a second aperture in the overlying surface that is aligned with a second aperture in the underlying surface.

10. The wire terminal clamping according to claim 1 wherein the recess in the wire clamping plate is vee-shaped.

11. The wire terminal clamp according to claim 1 wherein opposed vee-shaped recesses are provided, one in each side of the wire clamping plate such that when the plate is moved in one direction one of said recesses will cooperate with a first wire receiving aperture to clamp a wire and when the plate is moved an opposite direction, any wire end that is clamped will be released and the opposed recess will cooperate with a second wire receiving aperture to clamp a wire.

12. The wire terminal clamp according to claim 7 wherein the wire clamping plate has a first portion moveable in the channel and a second portion engageable by the screw feed means.

13. The wire terminal clamp according to claim 12 wherein the recess is formed in the first portion of the wire clamping plate and wherein at least one lug upstands from the second portion of the wire clamping plate, said lug having a screw threaded aperture dimensioned to mate with the screw feed means.

14. The wire terminal clamp according to claim 13 wherein the lug upstanding from the second portion of the plate is disposed between a pair of aligned lugs integral with the bracket and wherein apertures are provided in said pair of lugs in coaxial alignment with the aperature of the screw threaded lug of the wire clamping plate whereby the screw feed means passes sequentially through the aperture of one lug of the pair integral with the bracket, then through the aperture in the screw threaded lug of the wire clamping plate and then through the aperture in the second lug of the pair integral with the bracket to move the plate in one direction through the channel upon clockwise rotation of the screw and in the opposite direction upon counter clockwise rotation of the screw.

15. A wire terminal clamp comprising a carriage and a wire terminal bracket; said wire terminal bracket having first and second limbs, said limbs being at approximately 90° to each other and having on one limb a surface with an aperture for receiving a wire end; said carriage having a wire clamping plate having a recess at one edge dimensioned to accommodate a wire end, said wire clamping plate is movable in one direction across the surface to engage and clamp a wire end received in the aperture and is moveable in a second direction to release said clamped wire end.

16. The wire terminal clamp according to claim 15 wherein said wire clamping plate is moveable by screw feed means.

17. The wire terminal clamp according to claim 15 wherein an end of the limb having the aperture for receiving a wire end is overturned on itself to form an overlying surface and an opposing underlying surface such that a channel is formed between the underlying and overlying surface, wherein said wire clamping plate is movable in said channel.

18. The wire terminal clamp according to claim 17 wherein the wire clamping plate is movable by screw feed means.

19. The wire terminal clamp according to claim 17 wherein there is an aperture in the overlying underlying surface that is aligned with an aperture in the underlying overlying surface, such that the wire end received in one aperture will traverse the channel to be engaged in the aperture in the other surface.

20. The wire terminal clamp according to claim 15 wherein the recess in the plate is vee-shaped.

21. The wire terminal clamp according to claim 15, wherein opposed vee-shaped recesses are provided, one in each side of the wire clamping plate such that when the plate is moved in one direction one of said recesses will cooperate with a first wire receiving aperture to clamp a wire end and when the plate is moved in an opposite direction, the wire end that is clamped will be released and the opposed recess will cooperate with a second wire receiving aperture to clamp a different wire.

22. The wire terminal clamp according to claim 19 wherein the wire clamping plate has a first portion moveable in the channel and a second portion engageable by screw feed means.

23. The wire terminal clamp according to claim 22 wherein the recess is formed in the first portion of the wire clamping plate and wherein at least one lug upstands from the second portion of the wire, clamping plate, said lug having a screw threaded aperture dimensioned to mate with the screw feed means.

24. The wire terminal clamp according to claim 23 wherein the lug upstanding from the second portion of the wire clamping plate is disposed between a pair of aligned lugs integral with the bracket and wherein apertures are provided in said lugs in coaxial alignment with the aperature of the screw threaded lug of the wire clamping plate whereby the screw feed means passes sequentially through the aperture of one lug of the pair integral with the bracket, then through the aperture in the screw threaded lug of the wire clamping plate and then through the aperture of the second lug of the pair integral with the bracket to move the plate in one direction through the channel upon clockwise rotation of the screw and in the opposite direction upon counterclockwise rotation of the screw.

25. A wire terminal receptacle comprising at least one wire terminal clamp, a base and a housing, wherein the wire terminal clamp comprises a surface, a wire receiving means in said surface and a wire clamping plate having a recess at one edge dimensioned to accommodate a wire end, said wire clamping plate movable across said surface in a first direction and in a second opposite direction, such that when the wire clamping plate is moved in the first direction a wire end received in said wire receiving means can be engaged and clamped and when the wire clamping member is moved in the second opposite direction the wire end is released.

26. The wire terminal receptacle according to claim 25 wherein the wire terminal clamp is seated on the base and is covered by the housing.

27. The wire terminal receptacle according to claim 26, wherein he wire terminal clamp seated on the base is supported by a cylindrical shaped wall and a retaining wall.

28. The wire terminal receptacle according to claim 25 wherein two wire terminal clamps are seated on the base.

29. The wire terminal receptacle according to claim 28 wherein the wire terminal clamps are seated on the base in mirror image of each other.

30. The wire terminal receptacle according to claim 25 wherein the wire terminal clamp comprises a carriage and a wire terminal bracket; said wire terminal bracket having first and second limbs, said limbs being at approximately 90° to each other and having on one limb a surface with an aperture for receiving a wire end; said carriage having a wire clamping plate that is moveable in one direction across the surface to engage and clamp a wire end received in the aperture and is moveable in a second direction to release said wire end,

31. The wire terminal receptacle according to claim 30 wherein the second limb of the wire terminal clamp is configured to aid the seating of the wire terminal clamp on the base.

32. The wire terminal receptacle according to claim 30 wherein the surface of the wire terminal clamp is an underlying surface and is overturned on itself to form an opposing overlying surface such that a channel is formed between the underlying surface and the overlying surface, and wherein said wire clamping plate is moveable in said channel.

33. The wire terminal clamp according to claim 32 wherein there is an aperture in the overlying surface that is aligned with an aperture in the underlying surface, so a wire end received in one aperture will traverse the channel to be engaged in the aligned aperture in the opposing surface.

34. The wire terminal receptacle according to claim 33 wherein there is an aperture in the housing that is aligned with the apertures of the wire terminal clamp.

35. A wire terminal clamp comprising a carriage and a wire terminal bracket; said wire terminal bracket having first and second limbs, said limbs being at approximately 90° to each other and having on one limb a surface with an aperture for receiving a wire end; wherein an end of the limb having the aperture for receiving a wire end is overturned on itself to form an overlying surface and an opposing underlying surface such that a channel is formed between the underlying and overlying surfaces, said carriage having a wire clamping plate that is moveable in one direction in said channel to engage and clamp a wire end received in the aperture and is moveable in a second direction to release said wire end.

36. The wire terminal clamp according to claim 35 wherein said wire clamping plate is moveable by screw feed means.

* * * * *